US010029902B2

(12) United States Patent
Fahldieck

(10) Patent No.: US 10,029,902 B2
(45) Date of Patent: Jul. 24, 2018

(54) FILLING MACHINE

(71) Applicant: KHS GmbH, Dortmund (DE)

(72) Inventor: Andreas Fahldieck, Idar-Oberstein (DE)

(73) Assignee: KHS GmbH, Dortmund (DE)

( * ) Notice: Subject to any disclaimer, the term of this patent is extended or adjusted under 35 U.S.C. 154(b) by 361 days.

(21) Appl. No.: 14/778,741

(22) PCT Filed: Mar. 13, 2014

(86) PCT No.: PCT/EP2014/000677
§ 371 (c)(1),
(2) Date: Sep. 21, 2015

(87) PCT Pub. No.: WO2014/146770
PCT Pub. Date: Sep. 25, 2014

(65) Prior Publication Data

US 2016/0052766 A1 Feb. 25, 2016

(30) Foreign Application Priority Data

Mar. 19, 2013 (DE) ..... 10 2013 102 772

(51) Int. Cl.
*B67C 3/26* (2006.01)
*B67C 3/22* (2006.01)
*B65B 3/28* (2006.01)
*B67C 3/02* (2006.01)

(52) U.S. Cl.
CPC ..... *B67C 3/225* (2013.01); *B65B 3/28* (2013.01); *B67C 3/026* (2013.01); *B67C 3/22* (2013.01)

(58) Field of Classification Search
CPC ..... B67C 3/225; B67C 3/28; B67C 3/026; B67C 3/22
See application file for complete search history.

(56) References Cited

U.S. PATENT DOCUMENTS

| | | |
|---|---|---|
| 2,762,545 A | 9/1956 | Breeback |
| 6,148,876 A | 11/2000 | Corniani et al. |

FOREIGN PATENT DOCUMENTS

| | | |
|---|---|---|
| DE | 30 23 704 | 1/1982 |
| DE | 198 35 369 | 10/1999 |
| DE | 201 20 014 | 2/2003 |
| DE | 10 2007 041 684 | 3/2009 |
| DE | 10 2007 058 046 | 6/2009 |
| WO | WO 2009/068162 | 6/2009 |
| WO | WO 2009/103424 | 8/2009 |

*Primary Examiner* — Jason K Niesz
(74) *Attorney, Agent, or Firm* — Occhiuti & Rohlicek LLP

(57) ABSTRACT

A filling machine includes a rotor and a rotor mounting. The rotor mounting is formed by a rotary feed that also mounts the rotor to the machine frame.

24 Claims, 7 Drawing Sheets

FILLING MACHINE

RELATED APPLICATIONS

Under 35 USC 371, this is the national stage of international application PCT/EP2014/000677, filed on Mar. 13, 2014, which claims the benefit of the Mar. 19, 2013 priority date of German application DE 102013102772.5, the contents of which are herein incorporated by reference.

FIELD OF INVENTION

The invention relates to a filling machine, and in particular, to mounting a rotor of a filling machine.

BACKGROUND

Filling machines for filling bottles or other containers with a liquid product are known. Many of these known filling machines have a rotor that rotates about a vertical machine axis. At the periphery of such a rotor, several filling points are formed. Each filling point has a filling element and a container carrier to hold the containers during filling. In some cases, the rotor is freely suspended on a machine frame by a rotor mounting.

Also known are rotating filling machines in which a rotor mounting is provided on a lower machine part and on which the rotor rests with the filling points and a ring vessel. In these filling machines, the rotor mounting serves as a rotary distributor for the supply and removal of operating media. An operating medium is something other than the actual filling product with which containers are to be filled but that are nevertheless useful during operation of the filling machine. Examples of such operating media include compressed air for slip and lubricating means. For supply of filling product to the ring vessel provided on the rotor, a separate rotary feed is provided on the top of the rotor, coaxial with the machine axis.

SUMMARY

An object of the invention is to provide a rotating filling machine that is characterized by simple construction with high operating reliability.

The filling machine according to the invention, which is particularly suitable for filling containers with oil or as a pre-filler or metering filler, differs from known rotating filling machines by having a rotary feed that both supplies filling product to a vessel on the rotor and also mounts the rotor on the machine frame.

In one embodiment of a filling machine, the rotary feed is formed by a rotary passage having a first rotary passage element connected to the machine frame and preferably internal, and an outer rotary passage element that is mounted rotatably about the machine axis at or on the first rotary passage element and that is part of the rotor.

In a further embodiment, a vessel forms the rotary feed for the filling product. The vessel is mounted to be able to rotate and suspended on the machine frame. A lid that does not circulate with the rotor seals the vessel at its top. The vessel is preferably configured to be rotationally symmetric around the machine axis, with a vessel base and a vessel peripheral wall that are configured to be rotationally symmetric around the machine axis. A lid with a lid portion closes the vessel. The lid portion, which is shaped like a circular cylinder, surrounds the machine axis. This forms the connection to the vessel and extends into the vessel.

In one aspect, the invention features an apparatus for filling bottles with liquid filling product. Such an apparatus includes a filling machine that has: a rotor driven to rotate about a vertical machine axis, a machine frame, a rotor mounting that mounts the rotor to the machine frame, a plurality of filling elements provided on the rotor, a corresponding plurality of container carriers, a corresponding plurality of filling points, a rotor mounting, a rotary feed that forms the rotor mounting, an external product port that remains stationary while the rotor rotates, and a vessel provided on the rotor. Each container carrier from the corresponding plurality of container carriers and each filling element from the plurality of filling elements defines one of the filling points from the corresponding plurality of filling points. At each filling point, a container carrier holds a container at a filling element during filling thereof. Each of the container carriers holds a container with a container axis thereof oriented parallel to the vertical machine axis. During rotation, the rotor carries a first filling element from the plurality of filling elements from a first position, which is defined by a first angle, to a second position, which is defined by a second angle, the first and second angles defining an angular range in which the containers are filled. The first filling element fills a container while the first filling element is within the angular range. The external product port supplies filling product to the vessel through the rotary feed.

In some embodiments, the rotary feed is configured for suspended mounting of the rotor, whereas in others, it is configured for standing mounting of the rotor.

In some embodiments, the rotary feed comprises a rotary passage having a rotating outer part and a stationary inner part. The stationary inner part is fixed to the machine frame on a frame side, and the rotating outer part is part of the rotor. Among these are embodiments in which the rotating outer part surrounds the stationary inner part, and embodiments in which the second rotary passage part surrounds the first rotary passage part within an angular region thereof.

Also among these embodiments are those that further include a motor housing and a drive motor disposed in the housing. The drive motor has an output shaft connected to drive the rotor. The motor housing is connected to the stationary inner part.

Yet other embodiments include a rotor element from which the rotor is suspended by bolts. The rotor element in these embodiments is fixed to the rotating outer part.

Other embodiments include a plurality of spokes, each of which extends radially from the outer part of the rotary passage to the vessel. The resulting structure resembles spokes on a wheel.

In other embodiments, the filling machine is configured as a metering filler. In these embodiments, the rotary passage that forms the rotor mounting has a first path for the filling product and a second path for an additional component that is to be mixed with the filling product. Among these embodiments are those that also have an additional product vessel for the additional component.

Embodiments also include those in which the filling elements and the container carriers are provided on the rotating outer part, those in which they are provided on the vessel, and those in which they are connected to the vessel via a carrier element.

Another embodiment features a stationary lid and a port in the middle of the lid to supply product into the vessel. The port is coaxial with the machine axis. In this embodiment, the rotary feed includes a vessel suspended from the machine frame with the lid on top of the vessel to close of its interior. Among these embodiments are those having a ring seal that seals a transition between the vessel and a circular cylindrical lid portion of the lid that extends into the vessel. In some embodiments, there are two seals instead of one. The two seals are offset along the axial direction so that they form an annular chamber that can be filled with gas at positive pressure to suppress entry of foreign substances into the vessel.

Other embodiments include weighing cells, each of which is is coupled to a corresponding one of the container carriers for weighing a quantity of filling material added to a container at the container carrier.

Additional embodiments include a drive motor and a belt. that couples the drive motor to the rotor. In some of these embodiments, the belt lies directly against an outer face of the rotating outer part. In others, it lies directly against an outer face of the vessel.

In some embodiments, a drive motor is connected to drive the rotor with an output shaft. The drive motor is disposed in a housing connected to the machine frame. In other embodiments, the drive motor is at least partially in a chamber that is surrounded by the vessel.

As used herein, terms such as "substantially" or "approximately" refer to deviations from the precise value by ±10%, preferably by ±5%, and/or deviations in the form of changes insignificant for function.

Refinements, advantages, and possible applications of the invention arise from the following description of exemplary embodiments and from the figures. All features described and/or shown in the figures, alone or in arbitrary combination, in principle form the subject of the invention irrespective of their summary in the claims or back references. The content of the claims is made a constituent part of the description.

BRIEF DESCRIPTION OF THE DRAWINGS

These and other features and advantages of the invention will be apparent from the following detailed description and the accompanying figures, in which.

DETAILED DESCRIPTION

Figure 1:
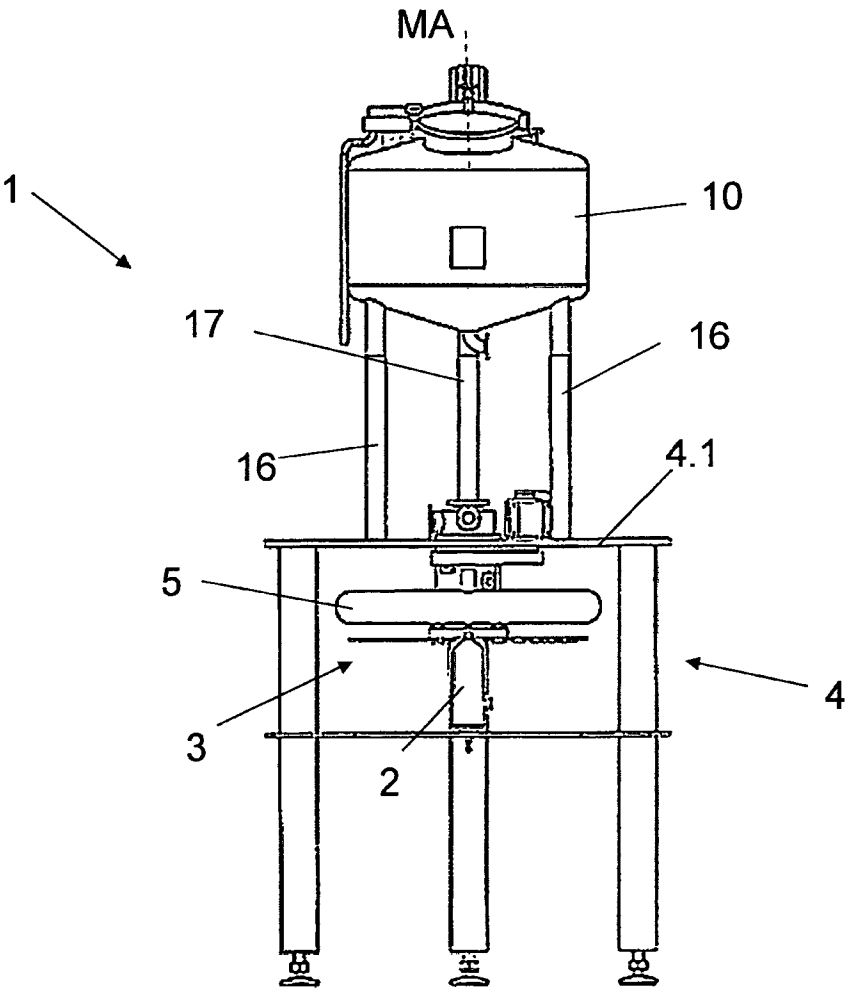
FIG. 1 shows a filling machine for filling bottles or similar containers with a liquid filling product.
Figure 2:
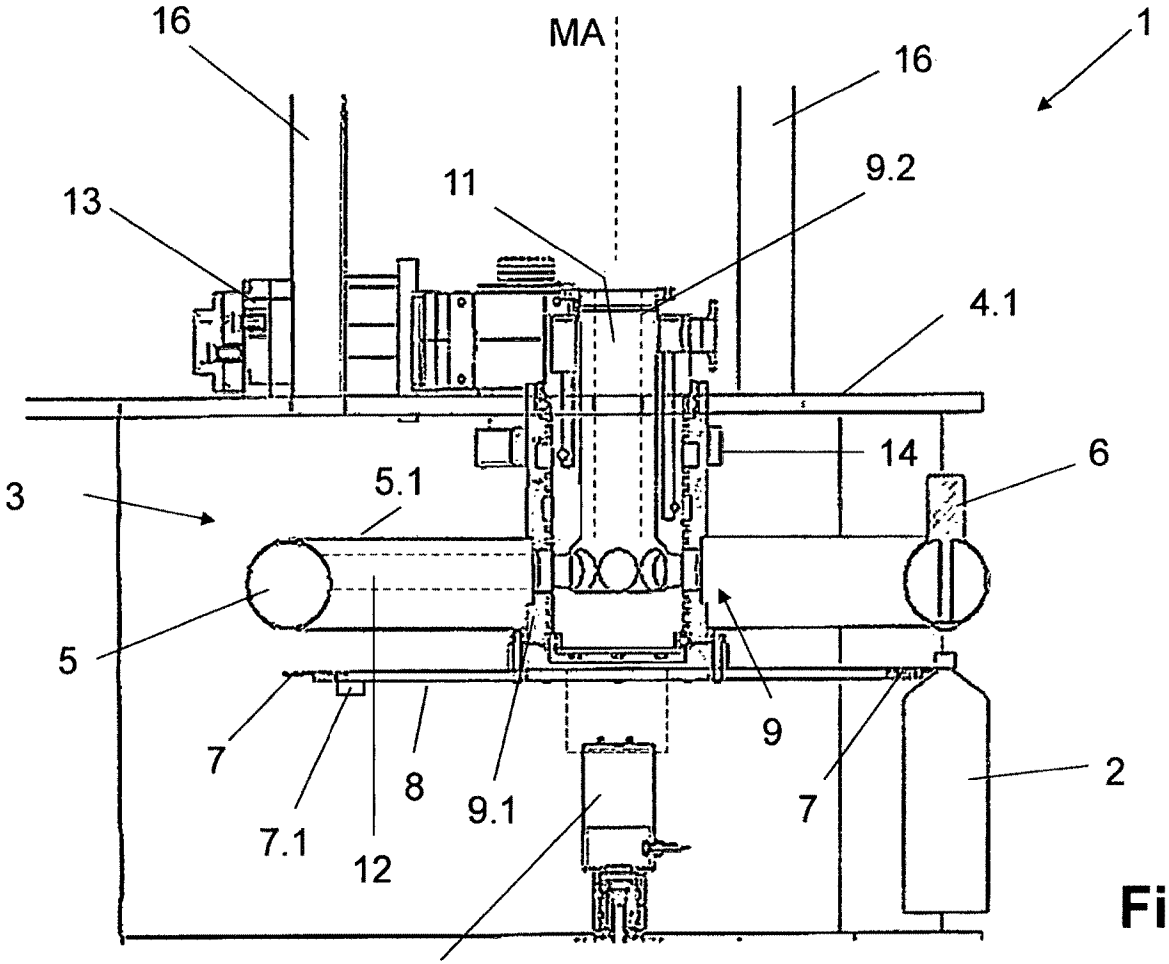
FIG. 2 shows a partial cross-section of the filling machine in FIG. 1.

FIGS. 1 and 2 show a filling machine 1 for filling bottles 2 with a liquid filling product, such as a beverage. The filling machine 1 includes a rotor 3 that can be driven to rotate about a vertical machine axis MA. A horizontal crosspiece 4.1 of a stationary machine frame 4 suspends the rotor 3.

The rotor 3 includes a ring vessel 5 that concentrically surrounds the machine axis MA. Filling elements 6, best seen in FIG. 2, are distributed at equal angular distances about a periphery of the rotor 3. A typical filling element 6 includes a liquid channel that forms a delivery opening through which the filling product passes into the container. Opening and closing a liquid valve controls how much product enters the container 2.

Associated with each filling element 6 is a container carrier 7 that suspends a bottle 2 by an opening flange or neck ring thereof with its bottle axis parallel to the machine axis MA. To help control how much filling product enters the bottle 2, each container carrier 7 includes a weighing cell 7.1 that supplies an electrical measurement signal. In the embodiment shown, the container carriers 7 are attached to a carrier element 8 connected to the ring vessel 5. The carrier element 8 is shaped like a disk or a ring.

For free-jet filling, the bottle's opening is spaced below a discharge opening provided at the filling element 6. It is not essential to suspend the bottle. In some embodiments, bottles stand on their container bases at the container carrier.

The filling product is stored in an external upper vessel 10 that is supported above the horizontal crosspiece 4.1 by several columns 16 on the crosspiece 4.1. A product pipe 17 connects the interior of the external upper vessel 10 to the filling elements via a rotary feed that also forms a rotor mounting for the rotor 3.

Radially extending spokes 5.1 connect the ring vessel 5 to a first rotary passage 9. The first rotary passage 9 allows passage of filling product from an external upper vessel 10 to the filling elements 6. This external upper vessel 10 has a larger volume than the ring vessel 5.

The first rotary passage 9 has a rotating outer part 9.1 and a stationary inner part 9.2. The rotating outer part 9.1, which is connected to the ring vessel 5 by a spoke 5.1, encloses the stationary inner part 9.2. The stationary inner part 9.2 is held on the crosspiece 4.1 and therefore does not rotate with the rotor 3. In contrast, the rotating outer part 9.1 is mounted to be able to rotate about the machine axis MA with the rotor 3.

The stationary inner part 9.2 makes a sealed connection with a first product channel 11, which receives liquid product from the product pipe 17. In the embodiment shown, the first product channel 11 is coaxial with the machine axis MA. At least one spoke 5.1 forms a second product channel 12 that opens into the ring vessel 5. During filling, the external upper vessel 10 keeps the ring vessel 5 supplied with liquid filling product via the first and second product channels 11, 12 and the rotary connection 9.

An electric drive motor 13 drives the rotor 3 to rotate about the machine axis MA during the filling operation. It does so by coupling to the rotor 3 via a belt 14 that connects the electric drive motor 13 and the rotor 3. A suitable belt 14 is a toothed belt. A suitable electric drive motor 13 is a gear motor.

In the embodiment shown, the belt 14 forms a closed loop about a corresponding belt pulley and an output shaft of the electric drive motor 13 and also directly about an outer surface of the rotating outer part 9.1. Other methods can be used to couple the electric drive motor 13 to the rotor 3. For example, in some embodiments, the electric drive motor 13 acts on a worm of a worm gear and the rotor 3 connects to the worm wheel of the worm gear.

Below the electric drive motor 13 and coaxial with the machine axis MA is a second rotary passage 15. Like the first rotary passage 9, the second rotary passage 15 has a rotatable part and a stationary part. The second rotary passage's rotatable part connects to the rotor 3 and conducts process and control media between the filling elements 6 and an external device that does not rotate with the rotor 3. In particular, the second rotary passage 15 conducts air used for pneumatic control, electrical power, and measurement signals, such as the weight signals from the weighing cell 7.1, between the rotor 3 and an external control device, such as a process computer.

In operation, the external upper vessel 10 and via this also the ring vessel 5 are filled with the liquid filling product. In one practice, the ring vessel 5 is completely filled and the external upper vessel 10 is partially filled. A container infeed supplies empty bottles to the filling machine 1. Once filled, the now-filled bottles exit the filling machine 1 via a container outlet.

As the rotor 3 carries a filling element 6 with a bottle 2 through the angular range, the filling element 6 fills the bottle 2. During filling, the weighing cell 7.1 of the associated container carrier 7 provides a measurement signal to a process computer. This provides information on how much the bottle 2 weighs, and therefore how much filling product is in the bottle 2. As soon as the necessary product quantity has been introduced into the bottle 2, the filling element's liquid valve closes.

Closure of the liquid valve occurs in response to an electrical control signal conducted via the second rotary passage 15 to an electrically controlled valve block that is provided on the rotor 3. This valve block controls one or more pneumatic actuating elements at each filling element 6.

The filling machine 1 is distinguished by its simple construction, and in particular, by the manner in which the rotary passage 9 also serves as a mounting for the rotor 3. Another distinguishing characteristic is that the drive motor 13 acts directly on the rotating outer part 9.1, namely via the belt 14 lying directly against an outer face of the rotating outer part 9.1.

Figure 3:
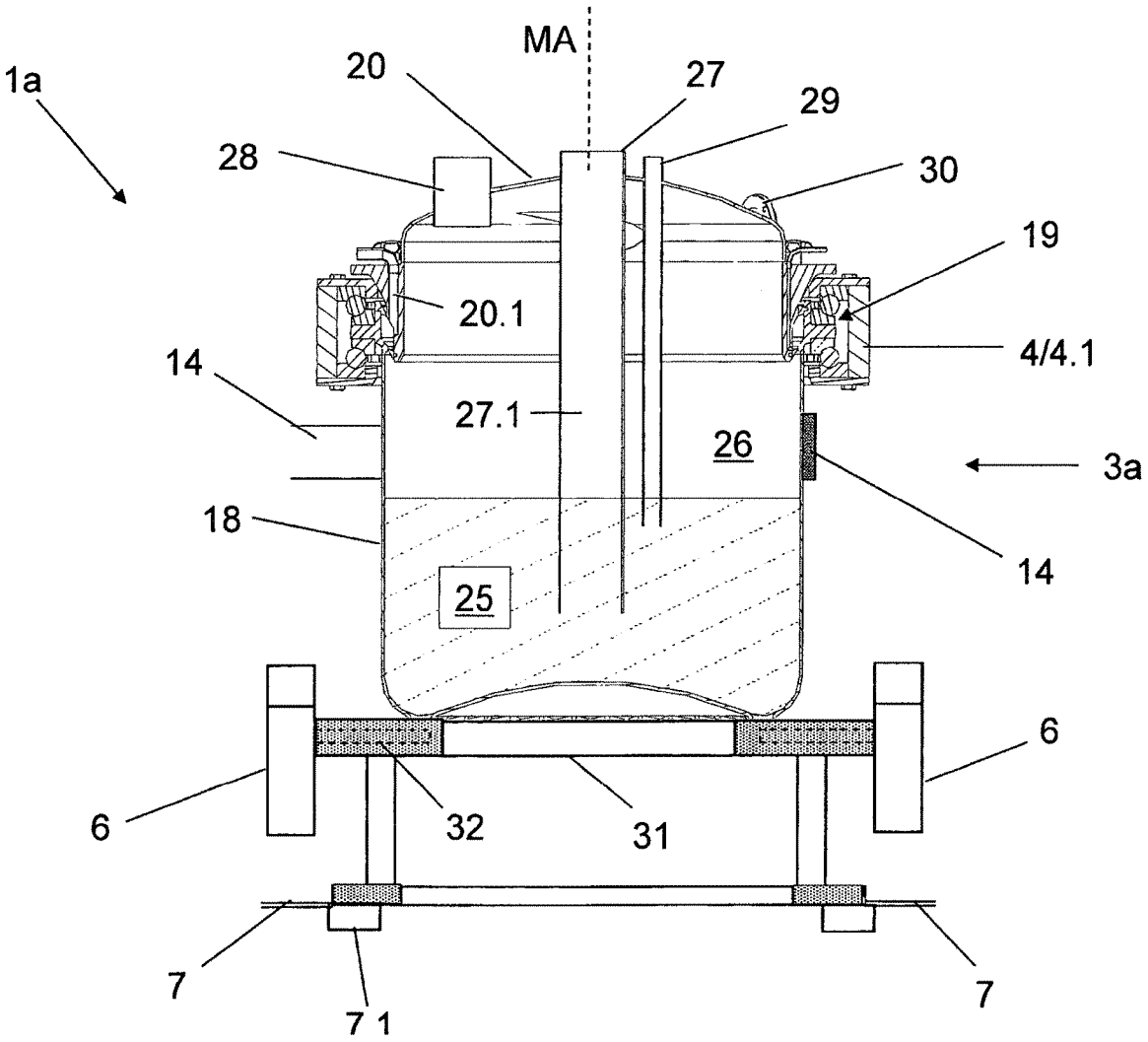
FIG. 3 shows a partial cross-section of another embodiment of a filling machine.

FIG. 3 shows part of an alternative embodiment of a filling machine 1*a* having a rotor 3*a*. In this embodiment, the function of the rotary passage 9 is carried out by a substantially bowl-like vessel 18 that is suspended from the machine frame 4 by an upper and lower rotary ball joint 19. The suspended vessel 18 is thus rotatable about the vertical machine axis MA. A lid 20 closes the top of the suspended vessel 18. This lid 20 does not rotate with a rotor 3*a* but is instead fixed to the machine frame 4.

Figure 4:
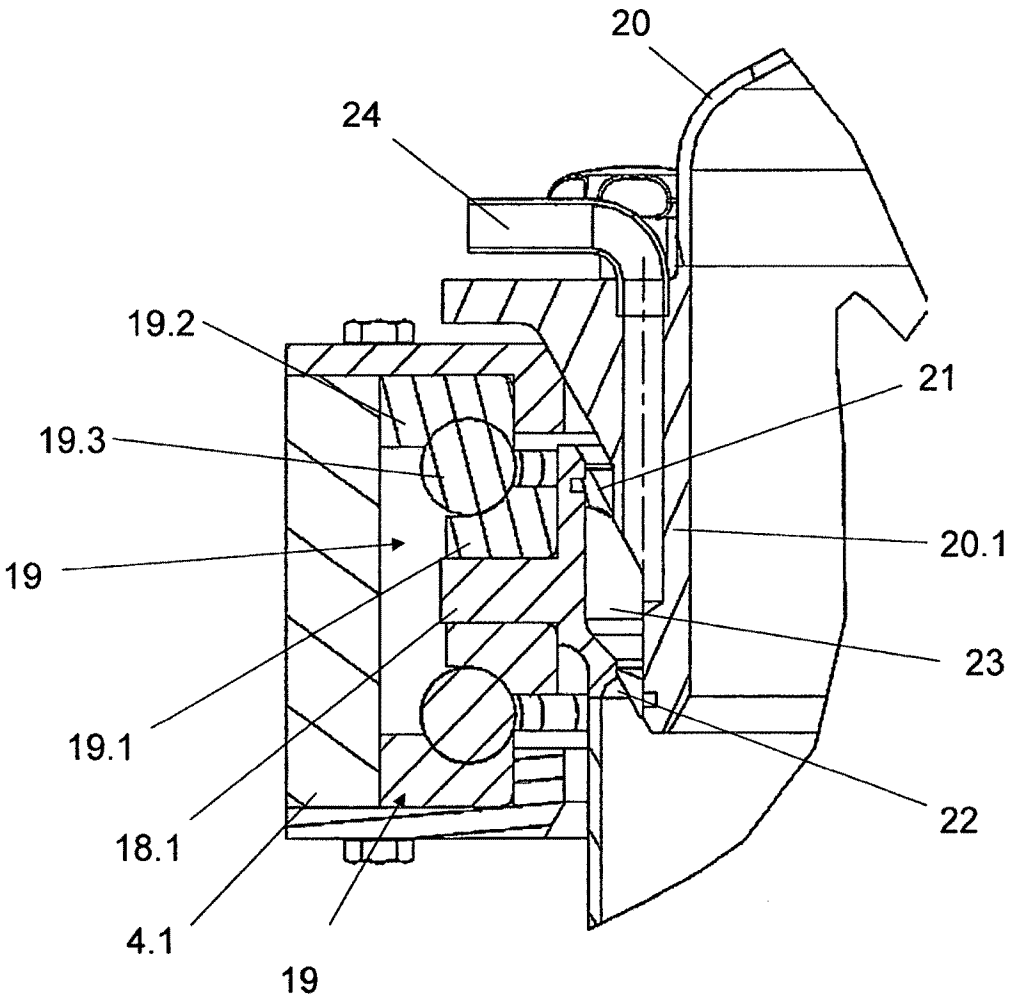
FIG. 4 shows an enlarged view of the mounting of a filling product vessel of the filling machine of FIG. 3.

As shown in FIG. 4, an upper open end of the bowl-like vessel 18 has an annular flange 18.1 that encircles the machine axis MA and that protrudes radially from the outer surface of the bowl-like vessel 18. The upper and lower rotary ball joints 19 couple the annular flange 18.1 to the machine frame 4. Each rotary ball joint 19 has a vessel-side raceway 19.1 provided on the flange 18.1, a frame-side raceway 19.2 attached to the machine frame 4, and a plurality of balls 19.3 arranged between these raceways 19.1, 19.2.

As shown in particular by FIG. 4, a lid portion 20.1 of the lid 20 extends into an opening of the bowl-like vessel 18. First and second ring seals 21, 22 that are offset from each other along the machine axis MA extend across a gap between the lid portion 20.1 and an inner face of the bowl-like vessel 18. As a result, the first and second ring seals 21, 22 not only seal a gap between the bowl-like vessel 18 and the lid portion 20.1 but also form an annular chamber 23. This annular chamber 23 is defined the first and second ring seals 21, 22, by the vessel inner face, and by the lid portion 20.1.

During operation of the filling machine 1*a*, the annular chamber 23 suppresses penetration of external substances, in particular germs, from the environment into the interior of the vessel 18. To promote such suppression, the annular chamber 23 is pressurized with a protective or inert gas under a slight pressure. This gas is supplied via a pressurization port 24 formed in the lid 20.

Referring back to FIG. 3, during a filling operation, filling product in the bowl-like vessel 18 defines a lower chamber 25 that contains the filling product and an upper chamber 26 filled with pressurized gas. A typical gas is a protective or inert gas, such as carbon dioxide gas.

The lid 20 also has a product port 27. In the illustrated embodiment, the product port 27 connects to a pipe section 27.1 that is open at both ends and that is coaxial with the machine axis MA. A gap between the product port 27 and the pipe section 20.1 is sealed as the pipe section 20.1 passes through the lid 20. The lower end of the pipe section 27.1 extends into the fluid chamber 25.

The lid 20 also has a media port 28 for supply and extraction of further media, a riser-pipe port 29, and a tangential port 30 that is used for the supply of liquid CIP cleaning medium, during CIP cleaning of the bowl-like vessel 18 and the filling machine 1*a*.

On a level that is immediately below the bowl-like vessel 18, a ring-like carrier element 31 carries the filling elements 6 and the corresponding container carriers 7, each of which has a weighing scale 7.1. The filling elements 6 are connected by corresponding product lines 32 to either the interior of the bowl-like vessel 18 or to a vessel port provided on the floor of the bowl-like vessel 18.

In the filling machine 1*a*, the bowl-like vessel 18 essentially forms the rotor 3*a*. A drive motor 13 drives the rotor 3*a* by a belt 14 that directly engages a circular cylindrical outer casing surface of the bowl-like vessel 18.

Figure 5:
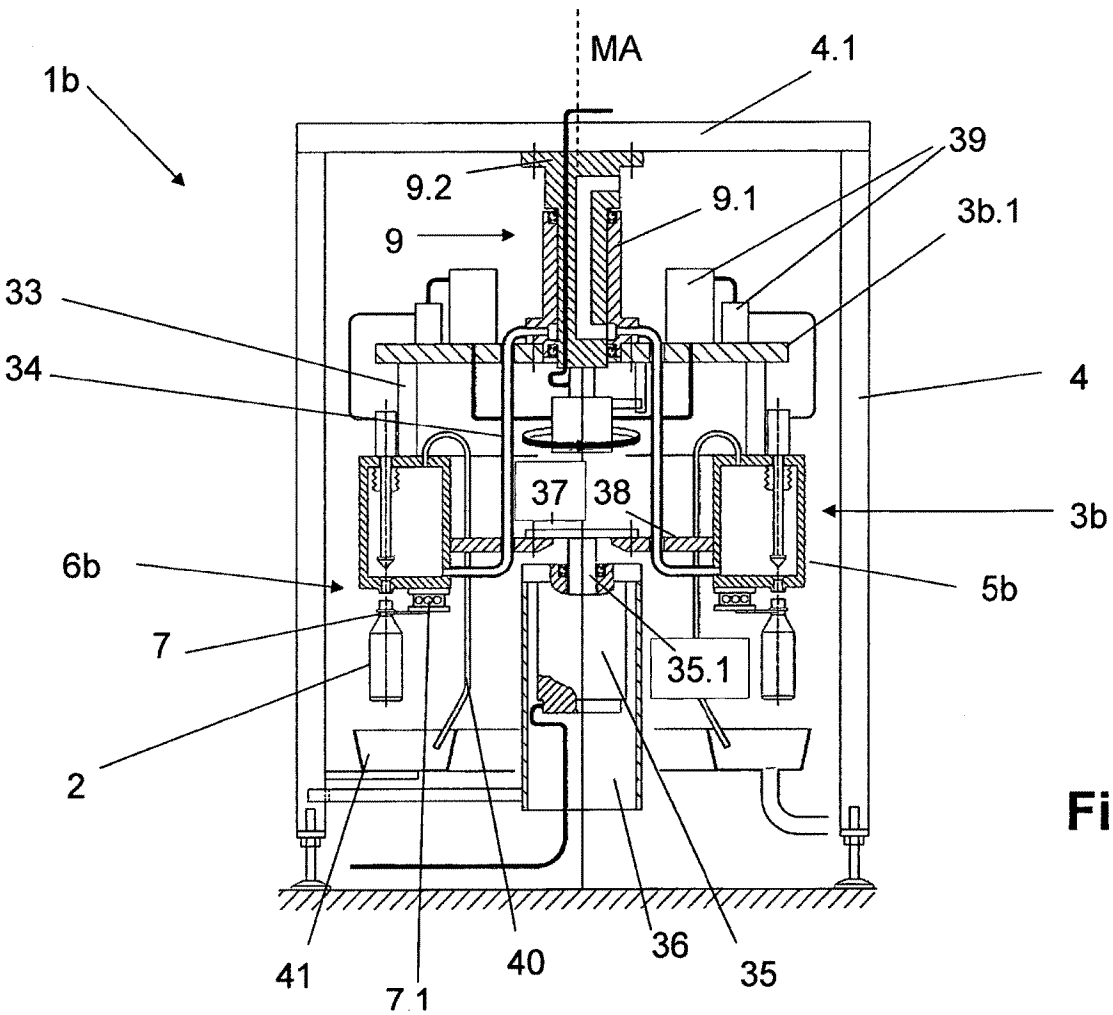
FIGS. 5 and 6 show further embodiments of a filling machine.

FIG. 5 shows another filling machine 1*b* with a rotor 3*b* suspended from a crosspiece 4.1 of a machine frame 4 in such a way as to permit the rotor 3*b* to rotate about the vertical machine axis MA. A rotary passage 9 supplies filling product from an external product line that does not move with the rotor 3*b*. This filling product ultimately reaches a ring vessel 5*b* that is suspended from a rotor element 3*b*.1 of the rotor 3*b* by a plurality of carrier bolts 33. One or more rotor-side product lines 34 connect the ring vessel 5*b* to the rotary passage 9 or to the rotating outer part 9.1, which is attached to the rotor 3*b*. The stationary inner part 9.2 is connected to the horizontal crosspiece 4.1. An additional rotary passage 15 is provided below the rotary passage 9 and below the rotor element 3*b*.1, and attached to the stationary inner part 9.2, coaxially with the machine axis MA. This additional rotary passage 15 provides operating media, such as compressed air, electrical data transmission, electrical power supply, etc.

For suspended mounting of the bottles 2, each filling element 6*b* on the ring vessel 5*b* comprises a container carrier 7 with a weighing cell 7.1. In some embodiments, instead of being suspended, bottles stand on their container bases on a weighing cell.

An electric motor 35 below the rotor 3*b* drives the rotor 3*b* via an output shaft 31.1 thereof that is coaxial with the machine axis MA. The motor 35 is held in a torque receiver 36 provided on the machine frame 4 below the rotor element 3*b*.1 and largely also below the level of the ring vessel 5*b*. The shaft 35.1 is connected via a disc or crosspiece 37 to the ring vessel 5*b* or to a ring 38, which is arranged coaxially to the machine axis MA and connected to and surrounded by the ring vessel 5*b*.

Various control elements 39 are provided on the rotor element 3*b*.1. These include valves and valve blocks for controlling the filling elements 6*b* or their liquid valves.

Lines 40 are distributed at even angular distances about the machine axis MA. Each line 40 has an upper end that opens into the ring vessel 5*b* on a top thereof. Each line 40 also has a lower end that opens into a ring trough 41 provided on the machine frame 4. The ring trough 41 forms an open ring channel around the machine axis MA. The lines 40 serve as purge and/or overflow pipes for the ring vessel 5*b*. The ring trough 41 captures any filling product emerging from the lines 40.

Figure 6:
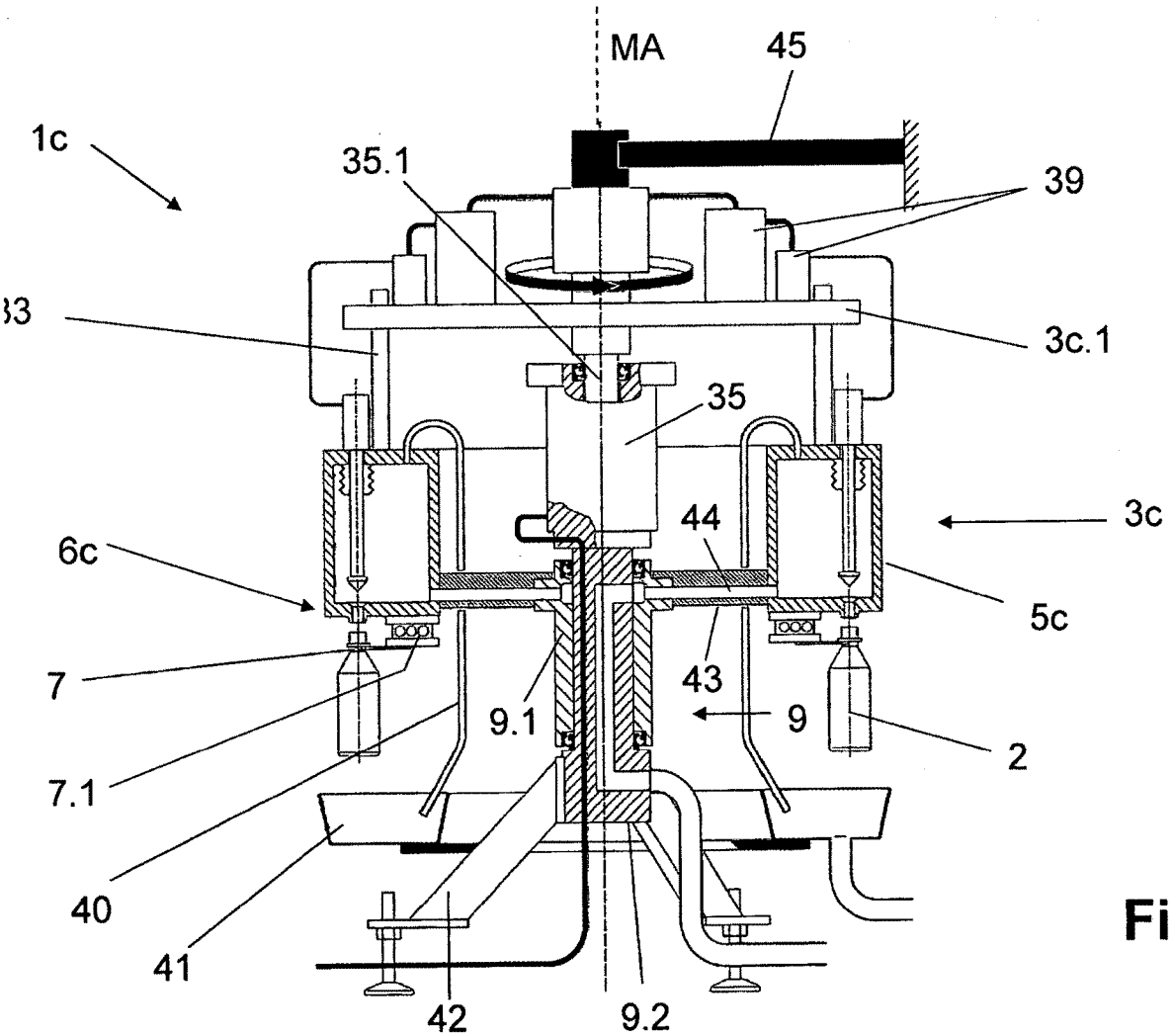

FIG. 6 shows a further embodiment of a filling machine 1*c* having a rotor 3*c*. The embodiment shown in FIG. 6 differs structurally from the filling machine 1*b* because the rotor 3*c* is not suspended. Instead, the machine frame 4 supports the rotor 3*c*. The filling machine includes several supporting feet 42 that are distributed about the machine axis MA. Each foot 42 connects to the rotary passage's stationary inner part 9.2. In this embodiment, the rotary passage 9 forms a support bearing for the rotor 3*c*, which includes a ring vessel 5*c*, filling elements 6*c*, container carriers 7 and weighing cells 7.1.

The filling machine 1*c* includes a plurality of spokes 43, each of which has a radially outer end that connects to the ring vessel 5*c* and a radially inner end that connects to the rotating outer part 9.1. The resulting structure is therefore not unlike spokes extending between a hub and a wheel. One or more product channels 44 formed in corresponding one or more spokes 43 connect the interior of the ring vessel 5*c* to the rotary passage 9.

An electric motor 35 is fixed above the level of the spokes 43 with a motor housing thereof on the stationary inner part 9.2 such that an output shaft 35.1 of the motor 35 is coaxial with the machine axis MA and protrudes from the top of the electric motor 35 in a direction away from the spokes 43. The motor shaft 35.1 connects to a rotor element 3*c*.1. In one embodiment, the rotor element 3.1 is a disc.

A plurality of bolts 33 connects the rotor element 3*c*.1 to the ring vessel 5*c* so that, when the electric motor 35 is switched on, the rotor 3*c*, which is formed substantially by this ring vessel 5*c* and the rotor element 3*c*.1, is driven to rotate about the machine axis MA. Control elements 39 and a second rotary passage 15 are provided on top of the rotor element 3*c*.1. The second rotary passage 15 is coaxial with the machine axis.

The rotary passage 15 includes a stationary portion that does not rotate with the rotor. This stationary portion connects to an arm 45 that connects to the machine frame 4 or to another base, thus forming a torque receiver. The rotary passage 15 permits passage of substances other than the filling product between the rotary reference frame of the rotor and the stationary reference frame of the surroundings. The filling machine 1*c* again has pipe sections 40 opening with their upper end in the ring vessel 3*c* and with their lower end in a trough 41.

The filling machines 1, 1*a*, 1*b*, 1*c* are suitable as pre-fillers or oil fillers. The filling machine according to the invention can also be formed as a metering filler as shown in FIG. 7.

Figure 7:
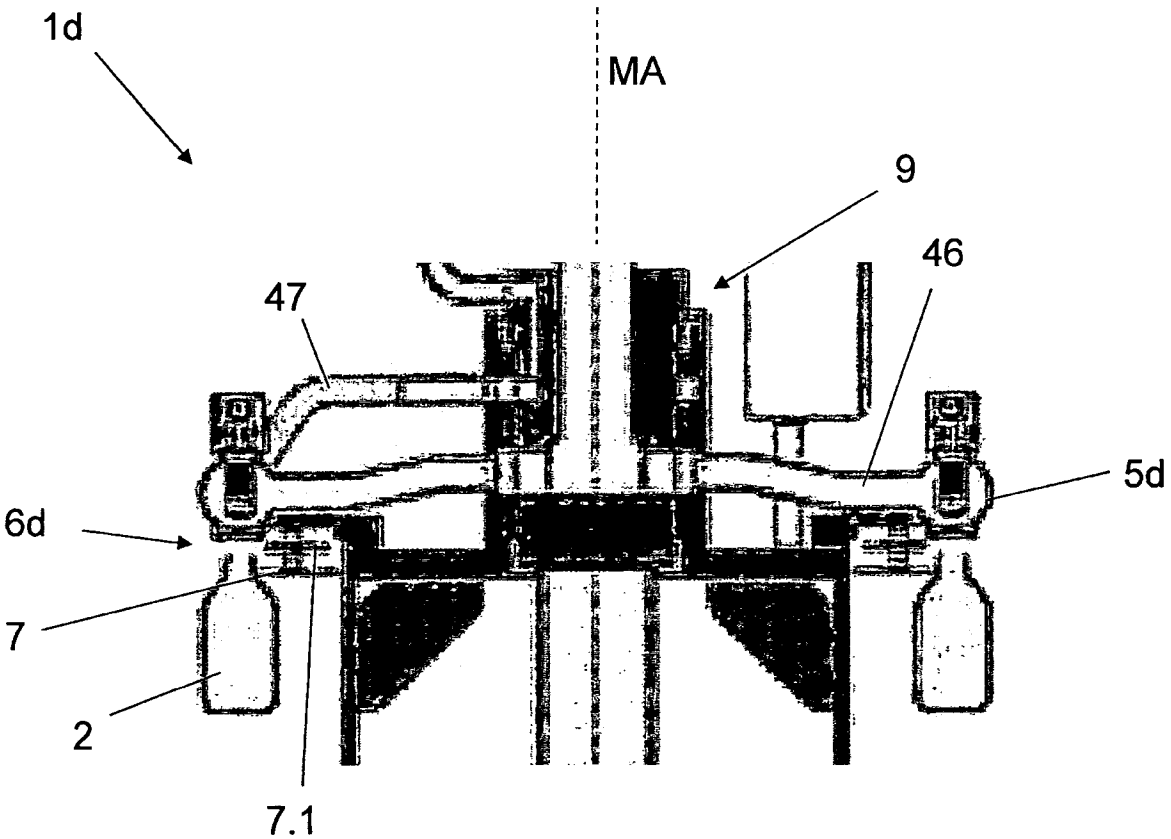
FIG. 7 shows a filling machine formed as a metering filler.

FIG. 7 shows a rotor 3*d* that is mounted rotatably about the machine axis MA by a rotary passage 9. In this embodiment, in addition to a product path connected to the ring vessel 5*d* via product lines 46, the rotary passage 9 also forms a further product path, also guided via the rotary passage 9, which is connected via additional product lines 47 to the ring vessel 5*d*. The additional product path supplies an additional component of the filling product. This additional component is metered out into the main component of the filling product supplied via the product lines 46.

The ring vessel 5*d* again has filling elements 6*d* with associated container carriers 7 for suspended or standing arrangement of the containers, as well as weighing cells 7.1. In this embodiment as a metering filler, there is also the possibility of providing a separate filling product vessel for each component, for example in the form of another ring vessel on the rotor 3*d*.

The invention has been explained above with reference to exemplary embodiments. It is evident that numerous changes and derivations are possible without leaving the inventive concept on which the invention is based.

Having described the invention, and a preferred embodiment thereof, what is claimed as new and secured by Letters Patent is:

1. An apparatus for filling bottles with liquid filling product, said apparatus comprising a filling machine, said filling machine comprising a rotor, a rotor mounting, a machine frame, a plurality of filling elements, a corresponding plurality of container carriers, a corresponding plurality of filling points, a rotary feed, a rotor mounting, an external product port, a vessel, a motor housing, and a drive motor disposed in said housing, wherein said rotor is driven to rotate about a vertical machine axis, wherein each container carrier from said corresponding plurality of container carriers and each filling element from said plurality of filling elements defines one of said filling points from said corresponding plurality of filling points, wherein said rotor mounting mounts said rotor to said machine frame, wherein said rotary feed forms said rotor mounting, wherein said filling elements are provided on said rotor, wherein, at each filling point in said corresponding plurality of filling points, a container carrier holds a container at a filling element during filling thereof, wherein each of said container carriers holds a container with a container axis thereof oriented parallel to said vertical machine axis, wherein said rotor, during rotation thereof, carries a first filling element from said plurality of filling elements from a first position, which is defined by a first angle, to a second position, which is defined by a second angle, said first and second angles defining an angular range in which said containers are filled, wherein said first filling element fills a container while said first filling element is within said angular range, wherein said external product port supplies filling product to said vessel through said rotary feed, wherein said vessel is provided on said rotor, wherein, during rotation of said rotor, relative motion exists between said rotor and said external product port, wherein said drive motor comprises an output shaft, wherein said drive motor is connected to drive said rotor, and wherein said motor housing is connected to a structure selected from the group consisting of said machine frame and said stationary inner part.

2. The apparatus of claim 1, wherein said rotary feed comprises a rotary passage, wherein said rotary passage comprises a rotating outer part and a stationary inner part, wherein said stationary inner part is fixed to said machine frame on a frame side, and wherein said rotating outer part is part of said rotor.

3. The apparatus of claim 2, wherein said rotary feed is configured for suspended mounting of said rotor.

4. The apparatus of claim 2, wherein said rotary feed is configured for standing mounting of said rotor.

5. The apparatus of claim 2, wherein said rotating outer part surrounds said stationary inner part.

6. The apparatus of claim 2, wherein said rotating outer part surrounds said stationary inner part within an angular region thereof.

7. The apparatus of claim 2, wherein said drive motor is connected to drive said rotor and wherein said motor housing is connected to said stationary inner part.

8. The apparatus of claim 2, further comprising a rotor element and bolts, wherein said rotor element is fixed to said rotating outer part and wherein said rotor is suspended from said rotor element by said bolts.

9. The apparatus of claim 2, further comprising a plurality of spokes, each of which extends radially from said outer part of said rotary passage to said vessel.

10. The apparatus of claim 2, wherein said filling machine is configured as a metering filler and wherein said rotary passage that forms said rotor mounting comprises a first path for said filling product and a second path for an additional component that is to be mixed with said filling product.

11. The apparatus of claim 10, further comprising an additional product vessel for said additional component.

12. The apparatus of claim 1, wherein said vessel comprises a ring vessel that is connected to said rotating outer part.

13. The apparatus of claim 1, wherein said filling elements and said container carriers are provided on said rotating outer part.

14. The apparatus of claim 1, wherein said filling elements and said container carriers are provided on said vessel.

15. The apparatus of claim 1, wherein said filling elements and said container carriers are connected to said vessel via a carrier element.

16. The apparatus of claim 1, further comprising a lid and a port, wherein rotary feed comprises said vessel, wherein said vessel is suspended from said machine frame, wherein said lid is disposed at a top of said vessel to close off an interior of said vessel, wherein said lid is stationary, as a result of which, in operation, relative motion exists between said lid and said rotor, and wherein said port is a port is disposed on a portion of said lid such that said port is coaxial with said vertical machine axis for supply of said filling product into said interior of said vessel.

17. The apparatus of claim 16, further comprising a first ring seal, wherein said lid comprises a circular cylindrical lid portion that concentrically surrounds said vertical machine axis and extends into said vessel, wherein said first ring seal seals a transition between said vessel and said circular cylindrical lid portion.

18. The apparatus of claim 17, further comprising a second ring seal, wherein said first and second ring seals are offset relative to each other along a direction defined by said vertical machine axis, wherein said first and second ring seals define an annular chamber that can be pressurized with a gas to suppress entry of foreign substances into said vessel.

19. The apparatus of claim 1, further comprising a corresponding plurality of weighing cells, wherein each weighing cell is coupled to a corresponding one of said container carriers for weighing a quantity of filling material added to a container at said container carrier.

20. The apparatus of claim 1, further comprising a belt, wherein said belt couples said drive motor to said rotor, wherein said belt lies directly against an outer face of said rotating outer part.

21. The apparatus of claim 1, further comprising a belt, wherein said belt couples said drive motor to said rotor, wherein said belt lies directly against an outer face of said vessel.

22. The apparatus of claim 1, wherein said drive motor is disposed at least partially in a chamber that is surrounded by said vessel.

23. The apparatus of claim 1, wherein said structure is said machine frame.

24. The apparatus of claim 1, wherein said structure is said stationary inner part.

* * * * *